US009644321B2

(12) United States Patent
Hauer

(10) Patent No.: US 9,644,321 B2
(45) Date of Patent: May 9, 2017

(54) METHOD FOR COATING A PAPER WEB

(71) Applicant: Peter Hauer, Hard (AT)

(72) Inventor: Peter Hauer, Hard (AT)

(73) Assignee: VITS TECHNOLOGY GMBH, Langenfeld (DE)

( * ) Notice: Subject to any disclaimer, the term of this patent is extended or adjusted under 35 U.S.C. 154(b) by 79 days.

(21) Appl. No.: 14/384,314

(22) PCT Filed: Apr. 11, 2013

(86) PCT No.: PCT/EP2013/057607
§ 371 (c)(1),
(2) Date: Sep. 10, 2014

(87) PCT Pub. No.: WO2013/164177
PCT Pub. Date: Nov. 7, 2013

(65) Prior Publication Data

US 2015/0086712 A1 Mar. 26, 2015

(30) Foreign Application Priority Data

May 2, 2012 (DE) ..... 10 2012 103 824

(51) Int. Cl.

| | |
|---|---|
| ***D21H 23/70*** | (2006.01) |
| ***D21H 27/24*** | (2006.01) |
| ***D21H 27/26*** | (2006.01) |
| ***D21H 17/48*** | (2006.01) |
| ***D21H 17/51*** | (2006.01) |
| ***D21H 19/12*** | (2006.01) |
| ***D21H 19/84*** | (2006.01) |
| ***D21H 23/56*** | (2006.01) |
| ***D21H 25/06*** | (2006.01) |

(52) U.S. Cl.
CPC ..... *D21H 23/70* (2013.01); *D21H 17/48* (2013.01); *D21H 17/51* (2013.01); *D21H 19/12* (2013.01); *D21H 19/84* (2013.01); *D21H 23/56* (2013.01); *D21H 25/06* (2013.01); *D21H 27/24* (2013.01); *D21H 27/26* (2013.01)

(58) Field of Classification Search
None
See application file for complete search history.

(56) References Cited

U.S. PATENT DOCUMENTS

| | | | |
|---|---|---|---|
| 4,244,990 | A | 1/1981 | Mayerhoffer |
| 4,940,503 | A | 7/1990 | Lindgren |

(Continued)

FOREIGN PATENT DOCUMENTS

| | | | |
|---|---|---|---|
| CN | 1727137 | A | 2/2006 |
| CN | 201310053 | A | 9/2009 |

(Continued)

*Primary Examiner* — Shamim Ahmed
*Assistant Examiner* — Bradford Gates
(74) *Attorney, Agent, or Firm* — Andrew Wilford

(57) ABSTRACT

The invention relates to a method for coating a paper web (1), comprising the steps in the following sequence: applying a first layer (20) made of a predetermined quantity of melamine resin to a first side of the paper web (1), first drying of the thus coated paper web (1) at a web temperature of at least 120° C., applying a second layer (21) made of a predetermined quantity of urea resin to a second side of the paper web (1), and second drying of the paper web (1) at a web temperature below 100° C.

6 Claims, 1 Drawing Sheet

(56) References Cited

U.S. PATENT DOCUMENTS

| | | | | |
|---|---|---|---|---|
| 6,231,670 | B1 | 5/2001 | Fischer | |
| 8,043,661 | B2 | 10/2011 | Linnemann | |
| 2009/0087643 | A1 * | 4/2009 | Gottzmann | B32B 5/24 428/323 |
| 2011/0159208 | A1 | 6/2011 | Price | |

FOREIGN PATENT DOCUMENTS

| | | | |
|---|---|---|---|
| DE | 19710549 | A | 9/1998 |
| DE | 102008008292 | A | 8/2009 |
| DE | 2230095 | A | 9/2010 |

* cited by examiner

METHOD FOR COATING A PAPER WEB

CROSS REFERENCE TO RELATED APPLICATIONS

This application is the US-national stage of PCT application PCT/EP2013/057607 filed 11 Apr. 2013 and claiming the priority of German patent application 102012103824.4 itself filed 2 May 2012.

FIELD OF THE INVENTION

The invention relates to a method of coating a paper web.

BACKGROUND OF THE INVENTION

Methods of this type are well-known per se. They are employed in order to make cover layers for laminates composed of boards and at least one layer of impregnated paper. This cover layer should have both a predefined decor and also advantageous physical and/or chemical properties, such as resistance to abrasion and/or resistance to scratching as well as resistance to water and chemicals. As a result, expensive melamine resins are generally used for the impregnation.

These coated and/or impregnated paper webs are well-known per se and are used, for example as furniture covering films or for floor laminates. This then requires meeting severe demands in terms of quality.

The known methods impregnate the decor paper with melamine resin and use hot air to dry it. When pressed together with the substrate, for example particle board under heat and pressure, the melamine resin has the effect of making the surface scratch-resistant and enabling the decor paper to be reliably bonded to the substrate. In order to reduce costs, substantially cheaper urea resin can be used for an initial impregnation. Both faces of the impregnated web must then be coated with melamine resin to achieve the desired surface properties of the laminate and to enable bonding to the board. This is labor-intensive, and more of the expensive melamine resin is used than is required for the surface quality.

If only one face of the web impregnated with pure urea resin is coated with melamine resin, it is impossible to bond it to the substrate since the urea resin is already too highly cross-linked due to the higher temperatures required to dry the melamine resin and thus does not have sufficient adhesive strength.

It is desirable when impregnating paper webs to largely replace the melamine resin with significantly cheaper urea resin.

WO 2008/134823 [US 2010/0159708] describes a method of producing impregnated paper in which urea resin is used for impregnation. Drying is effected by near-infrared radiation, thereby largely precluding cross-linking of the resin. When the film impregnated with the urea resin is pressed together with the substrate, the low level of cross-linking allows bonding to be reliably effected. One disadvantage of the method is that it does not provide the requisite operational reliability. It is furthermore costly in terms of the electrical power needed. In the case of colored decor types, certain areas of varying colors are dried differently due to variations in absorption and reflection, with the result that the overall web has a nonuniform level of moisture.

A further problem is the fact that the urea resin does not exhibit the required mechanical strength and thus undergoes excessively rapid wear. It is therefore necessary to provide one surface of the laminate with a qualitatively higher-grade layer composed, for example of melamine resin. This can be achieved in the case of floor laminates by using so-called overlay papers that are provided with special properties by special coatings and/or impregnations. These overlays are too costly for furniture since the quality of the surface must meet somewhat less stringent requirements. Coating the paper webs impregnated with urea resin subsequently with melamine resin is impossible since the high temperatures used for the prior cross-linking of the melamine resin have a negative effect on the urea resin which undergoes excessive cross-linking in the process and is thus no longer able to bond.

OBJECT OF THE INVENTION

The object of the invention is to provide a method that allows furniture films to be made more cost-effectively while meeting all quality requirements.

SUMMARY OF THE INVENTION

The object is achieved according to the invention by a method of coating a paper web that is done in the following sequential steps: a first layer consisting of a predetermined quantity of melamine resin is applied to a first face of the paper web; then both in terms of time and space immediately following the application of the first layer (in line) the paper web is dried at a web temperature of at least 120° C.; then a second layer consisting of a predetermined quantity of urea resin is applied to a second face of the paper web; and finally the paper web is dried at a web temperature of between 90° and 110° C.

Additional steps such as, for example cutting the paper web into sheets can follow the second drying.

The method achieves the result that a paper web can be made that is coated with urea resin and melamine resin and the fractional proportion of urea resin is relatively high while that of melamine resin is correspondingly low. The second face of the paper web coated with urea resin is intended to be bonded to a substrate, for example a wooden panel. In a subsequent step, the paper web that has been thus coated can be flawlessly and permanently bonded to the substrate by applying heat and pressure (pressing); this is because the urea resin undergoes only a little cross-linking due to the low web temperature during the second drying. In addition, the paper web after pressing has a surface that meets all quality criteria such as hardness, scratch resistance, and abrasion resistance since now the inherent superior properties of the melamine resin are effective.

Expert opinion has previously assumed that a paper web for impregnation and/or coating of one face that meets requirements must be completely saturated with resin so as to completely displace trapped air pockets in the paper web. Only then are subsequent applications of material possible. It was thus believed that the paper web that was thinly coated on one face with resin and immediately dried thereafter without allowing the resin to mostly or even completely impregnate the paper cannot be made without trapped air pockets. This is because it was assumed that the second layer in the paper web is not able to completely displace any air remaining after the first coating action.

Trapped air pockets are highly detrimental to the visual appearance of the finished pressed substrate and thus often result in the substrate's being unusable.

What has been surprisingly found, however, is that the finished pressed substrate with the paper web made by the inventive method is also of flawless appearance, in particular, free of any trapped air pockets. As a result, a substantial fraction of the resin can be composed of urea resin based on the method according to the invention, thereby achieving a considerable cost savings.

The paper web in one embodiment is composed of a decor paper. This enables a desired appearance to be achieved for the substrate. The method has proven to be especially well-suited for decor papers.

In another embodiment, abrasion-resistant particles composed for example of corundum are added to the first layer of melamine resin. This increases the wear resistance of the first layer.

In another embodiment, the speed of the web during coating and drying is at least 15 m/min. This ensures that almost none of the melamine resin penetrates into the paper web between the first coating and the first drying such that the melamine resin is almost entirely available as the wear layer.

In another embodiment, application of the first layer is effected in a gap. This means that an applicator includes a catch element that creates the gap with a deflecting roller. The melamine resin, which optionally includes the hard particles, is introduced into the gap and thereby applied to the first face of the paper web. This has proven to be especially effective for the inventive method.

BRIEF DESCRIPTION OF THE DRAWING

The invention is described below in more detail with reference to the attached schematic drawing. Therein.

SPECIFIC DESCRIPTION OF THE INVENTION

Figure 1:
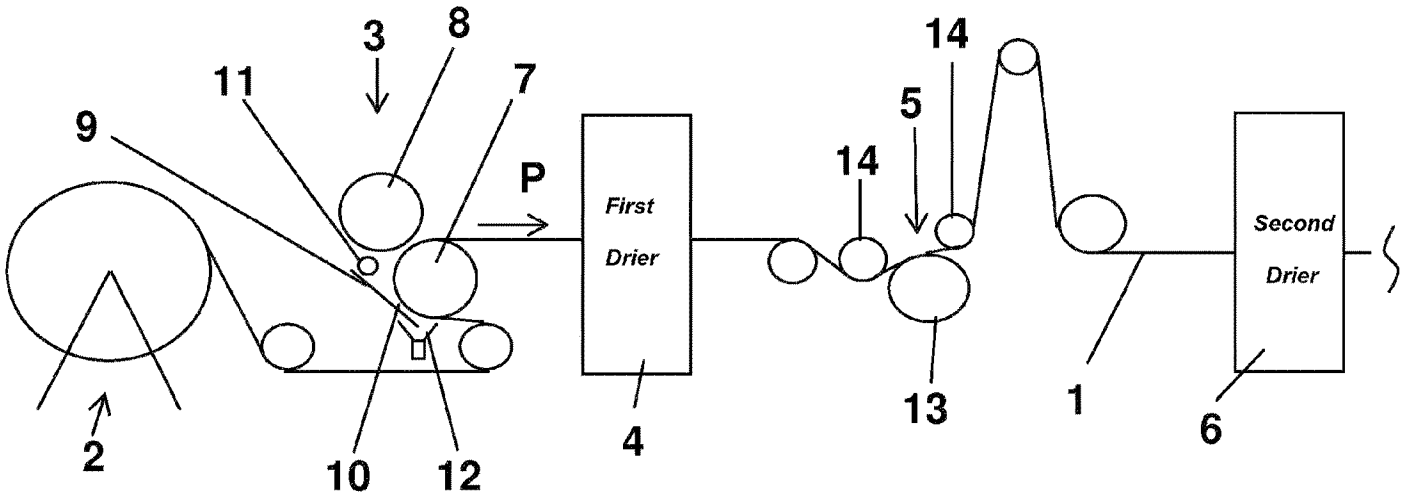
FIG. 1 is a side view of an apparatus for carrying out the method.

As shown in FIG. 1, an apparatus for carrying out the method comprises an unwinder 2 for a paper web 1, a first applicator 3, a first drier 4, a second applicator 5, and a the second drier 6. An unillustrated take-up roller or a cross-cutter including a stacker are provided downstream of the second drier 6.

The paper web 1 is composed of a printed or unprinted paper weighing between 20 and 250 g/m$^2$. In the case of a printed paper web 1, the paper's first face is the printed face.

The first applicator 3 used to apply a first coating compound to the first face of the web 1 comprises a deflecting roller 7 to redirect the web 1 and a feed roller 8. The deflecting roller 7 and the feed roller 8 are offset from each other both vertically and but have parallel rotational axes.

A catch element 9 associated with the deflecting roller 7 is formed by an essentially planar plate extending parallel the axial length of the deflecting roller 7. The element 9 is below the feed roller 8 and forms a gap 10 with the deflecting roller 7. This element extends at an acute angle to the vertical in the wrap-around zone of the web 1 on the deflecting roller 7, and approaches at a lower end region so close to the roller's outer surface that it almost touches the web 1 tangentially and seals the gap 10 at the bottom. The axial ends of the gap 10 are open. A manifold 11 introduces the first coating compound into the gap 10 and is connected to a supply line. A drip tray 12 below the deflecting roller 7 collects any overflow of the first coating compound. The drip tray 12 is a connected to a recirculation system for the first coating compound.

The feed roller 8 and the deflecting roller 7 form a narrow adjustable feed gap.

The first drier 4 is downstream in the transport direction (arrow P) of the first applicator 3 and is a circulating-air, flotation drier. A spacing between the first applicator 3 and the first drier 4 is kept as small as possible, measuring less than 2 m. Combined with a high web speed, a first drying is effected in terms of time and space immediately following an application of a first layer 20 so as to essentially prevent saturation of the web 1.

The second applicator 5 for applying a second coating compound to a second face of the web 1 is downstream of the first drier 4, and comprises an anilox roller 13 and two pressure rollers 14 that provide a predetermined wrap angle of the web 1 on the anilox roller 13. Urea resin can be applied using conventional means as the second coating compound and the supply can be regulated, for example by a doctor blade.

The second drier 6 is downstream of the second applicator 5 and essentially corresponds to the first drier 4.

In a so-called breathing section is provided between the second applicator 5 and the second drier 6 the web 1 passes through multiple loops so as to extend the travel distance, thereby achieving the greatest possible saturation of the web 1.

When operating, the web 1 is pulled off a supply roll that is mounted in the unwinder 2 and moved to the first applicator 3. Here the web 1 is moved around the deflecting roller 7 and through the feed gap.

The speed of the web 1 is at least 15 m/min.

Any excess amount of the first coating compound is pumped from a supply tank through the manifold 11 into the gap 10. A portion of the first coating compound, which is essentially composed of melamine resin in aqueous solution and optional hard particles, is entrained as the first layer 20 by the first face of the web 1 and fed at a predetermined grammage in the feed gap. Excess amounts of the first coating compound flow out the open ends of the gap 10 into the drip tray 12. From here the excess first coating compound is recirculated back into the supply tank.

The web 1 including the first wet layer 20 then enters the first drier 4 and is dried here to a predetermined residual moisture level at relatively high temperatures at which the web temperature reaches between approximately 110° and 140° C.

Since very little time elapses between the application of first layer 20 and the first drying, the first coating compound only incompletely saturates the web 1. This is intentional so that the first layer 20 gets as much as possible as the wear-resistant layer.

Following the first drying, the second coating compound composed of urea resin in aqueous solution is applied in a predetermined quantity in the second applicator 5 to a second face of the web 1 as the second layer 21.

The web 1 including the layers 20 and 21 then passes through a dwell section in which the second coating compound penetrates into the web 1 such that the web is partially infused with the first coating compound and otherwise infused with the second coating compound.

Downstream of the dwell section, the coated web 1 is dried in the second drier 6 to a predetermined final moisture level such that a web temperature measures 90° to a maximum of 110° C.

Following the second drying, the finished coated web 1 is either cut into sheets that are stacked, or wound up into a roll.

Figure 2:
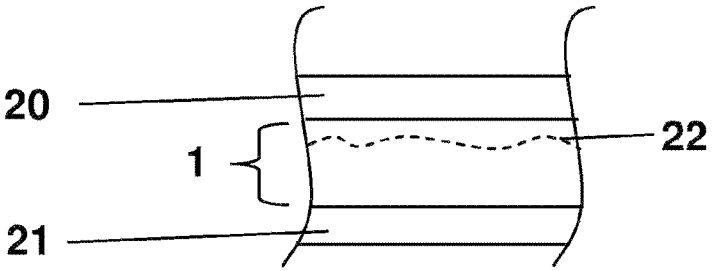
FIG. 2 is a section through a coated paper web.

A layer structure for the finished coated and dried web 1 is shown in FIG. 2. The first layer 20 is formed on the first printed top face here of the web 1. This layer penetrates only partially through the web 1, as indicated by a dotted line 22. The second layer 21 is applied to the second face of the web 1 that is opposite the first and is contiguous with first layer 20 inside the paper.

The invention is described based on one embodiment in which the first layer 20 is applied in the gap 10 and the second layer 21 is applied with an anilox roller 13. Other known coating apparatuses can also be used instead of these application methods.

The invention claimed is:

1. A method of coating a paper web, the method comprising the steps of sequentially:

applying a first layer composed of a predetermined quantity of only melamine resin to a first face of the paper web;

first drying the paper web immediately after the application of the first layer at a web temperature of between 110° and 140° C.;

applying a second layer composed of a predetermined quantity of only urea resin to a second face of the paper web; and second drying the paper web to which the second layer is applied at a web temperature of between 90° and 110° C.

2. The method according to claim 1, wherein the paper web is a decor paper.

3. The method according to claim 1, further comprising the step of:

adding hard particles to the melamine resin prior to application to the first face of the paper web.

4. The method according to claim 1, further comprising the step of:

conveying the web at a web speed is at least 15 m/min during application of the first and second layers and drying.

5. The method according to claim 1, wherein the application of the first layer is effected in a gap.

6. The method according to claim 5, wherein the gap is defined between a catch element and a deflecting roller.

* * * * *